US009284683B2

(12) United States Patent
Arnold et al.

(10) Patent No.: US 9,284,683 B2
(45) Date of Patent: Mar. 15, 2016

(54) HIGHLY DURABLE OUTDOOR TEXTILE FABRIC HAVING IMPROVED RESISTANCY AND REPELLENCY

(75) Inventors: Juergen Arnold, Dasing (DE); Betty Tilley, Oak Ridge, NC (US); Ray Seals, Greensboro, NC (US); Robert Manley, Gastonia, NC (US)

(73) Assignee: Huntsman International LLC, The Woodlands, TX (US)

( * ) Notice: Subject to any disclaimer, the term of this patent is extended or adjusted under 35 U.S.C. 154(b) by 1084 days.

(21) Appl. No.: 12/603,018

(22) Filed: Oct. 21, 2009

(65) Prior Publication Data

US 2010/0120309 A1 May 13, 2010

Related U.S. Application Data

(60) Provisional application No. 61/107,082, filed on Oct. 21, 2008.

(51) Int. Cl.

| | |
|---|---|
| ***B05D 1/00*** | (2006.01) |
| ***D06M 15/564*** | (2006.01) |
| ***D06M 15/256*** | (2006.01) |
| ***D06M 15/277*** | (2006.01) |
| ***D06M 15/568*** | (2006.01) |
| ***D06M 15/572*** | (2006.01) |
| ***D06M 15/576*** | (2006.01) |

(52) U.S. Cl.

CPC ..... *D06M 15/564* (2013.01); *D06M 15/256* (2013.01); *D06M 15/277* (2013.01); *D06M 15/568* (2013.01); *D06M 15/572* (2013.01); *D06M 15/576* (2013.01); *D06M 2200/11* (2013.01); *D06M 2200/12* (2013.01); *Y10T 442/2066* (2015.04)

(58) Field of Classification Search

CPC ..... D06M 15/256; D06M 15/564; D06M 15/576; D06M 15/277; D06M 15/568; D06M 15/572; D06M 2200/11; D06M 2200/12; Y10T 442/2066

USPC ..... 427/209

See application file for complete search history.

(56) References Cited

U.S. PATENT DOCUMENTS

| | | | | |
|---|---|---|---|---|
| 4,304,812 | A | 12/1981 | Perkins | |
| 4,400,414 | A * | 8/1983 | DeMott | 427/210 |
| 5,135,542 | A | 8/1992 | Sasakura et al. | |
| 5,389,430 | A | 2/1995 | Yilgor et al. | |
| 5,464,545 | A | 11/1995 | Isharani et al. | |
| 5,747,392 | A | 5/1998 | Xiao et al. | |
| 6,207,250 | B1 * | 3/2001 | Bullock et al. | 428/137 |
| 6,531,228 | B1 | 3/2003 | Bartelink et al. | |
| 6,776,804 | B2 | 8/2004 | Crabtree et al. | |
| 6,818,253 | B2 | 11/2004 | Kimbrell | |
| 6,884,491 | B2 | 4/2005 | Rubin et al. | |
| 7,157,388 | B2 | 1/2007 | Langley et al. | |
| 7,244,371 | B2 | 7/2007 | Fang et al. | |
| 7,329,367 | B2 | 2/2008 | Elgarhy | |
| 7,407,899 | B2 | 8/2008 | Wang et al. | |
| 7,531,219 | B2 | 5/2009 | Rubin et al. | |
| 7,638,444 | B1 * | 12/2009 | Bullock et al. | 442/93 |
| 2003/0116744 | A1 | 6/2003 | Kimbrell et al. | |
| 2004/0023578 | A1 | 2/2004 | Sobieski et al. | |
| 2004/0137814 | A1 | 7/2004 | Kimbrell, Jr. et al. | |
| 2006/0155046 | A1 * | 7/2006 | Moors et al. | 524/507 |
| 2007/0021019 | A1 | 1/2007 | Rubin et al. | |
| 2007/0072502 | A1 | 3/2007 | Underwood et al. | |

FOREIGN PATENT DOCUMENTS

| | | |
|---|---|---|
| WO | WO 02/04737 | 1/2002 |
| WO | WO 2007/018835 | 2/2007 |

* cited by examiner

*Primary Examiner* — Robert S Walters, Jr.

(57) ABSTRACT

The present invention relates to a highly durable, water resistant, and water and/or oil repellent outdoor textile fabric. The outdoor textile fabric may be prepared by treating the front surface of the textile fabric with an aqueous treatment composition containing a fluorochemical agent and applying a second treatment composition containing a polyurethane to the back surface of the textile fabric. The outdoor textile fabric may be used in a variety of outdoor applications including automotive and marine applications, as a cover, canopy or banner, in military applications, as an awning, tent, umbrella, or in casual outdoor furniture.

14 Claims, No Drawings

HIGHLY DURABLE OUTDOOR TEXTILE FABRIC HAVING IMPROVED RESISTANCY AND REPELLENCY

CROSS-REFERENCE TO RELATED APPLICATION

This application claims priority to U.S. Pat. App. No. 61/107,082 filed on Oct. 21, 2008 which is incorporated herein by reference.

STATEMENT REGARDING FEDERALLY SPONSORED RESEARCH OR DEVELOPMENT

Not applicable.

FIELD OF THE INVENTION

The present invention is directed to treated textile fabrics and to a method of treating a textile fabric. In particular, the present invention relates to a method of preparing a water resistant, water and/or oil repellent, highly durable textile fabric, and to the textile fabric so prepared.

BACKGROUND OF THE INVENTION

Fabrics that are appropriate for use in outdoor applications must be durable and be able to withstand weather and other environmental conditions to which they are often subjected. Properties generally considered when designing and producing such fabric include liquid resistance and repellency, UV blocking and resistance, abrasion resistance, breathability, fire resistance, aesthetic quality, durability, functionality and ease of manufacturability.

Several attempts have been made in the past to improve the above-mentioned properties by applying one or more coatings onto the fabric. For example, U.S. Pat. No. 6,884,491 discloses a process of coating a fabric with various chemicals including a fluorochemical agent, an antimicrobial agent, a crosslinking agent and a fire retardant to form a primarily treated water and stain resistant fabric. The back of the fabric is then coated with a polymeric film to render the fabric water repellent. In U.S. Pat. No. 5,747,392, low and high solids coating formulations containing a urethane latex, an acrylic latex, a crosslinking agent and a fluorochemical agent are utilized to provide stain resistancy and water repellency to a transfer printable fabric.

A need exists to improve upon the textile fabrics described in the patents mentioned above. In particular, it would be desirable to provide improved highly durable, water resistant, and water and/or oil repellent and optionally flame retardant textile fabrics which can be used in rigorous and dynamic outdoor applications.

SUMMARY OF THE INVENTION

The present invention relates to a process for preparing a highly durable, water resistant and water and/or oil repellent outdoor textile fabric by selecting an untreated textile fabric and treating the front surface, and optionally the back surface, of the textile fabric with an aqueous treatment composition containing from about 0.1 weight percent to about 5 weight percent of a fluorochemical agent. The treated textile fabric is then dried to form an initially treated fabric. A second treatment composition containing from about 40 weight percent to about 85 weight percent of a polyurethane and optionally a fluorochemical agent is applied to the back surface of the initially treated fabric and dried to form the outdoor textile fabric.

DETAILED DESCRIPTION OF THE INVENTION

The term "water resistant" generally means a fabric that is essentially impermeable to liquids, such as water. In comparison, "water repellency" and "oil repellency" generally imply a lesser degree of resistancy and refer to the beading up and running off of water or oil on the surface of the textile fabric.

The present invention is directed to a process for producing highly durable, water resistant, and water and/or oil repellent textile fabric for use in outdoor applications that retains its natural "hand" or texture and is therefore aesthetically attractive. In addition, the outdoor textile fabric exhibits exceptional hydrostatic pressure and fire resistant properties as well as providing protection from outdoor elements such as visible light, infra-red heat, heat, organic particles, pollution residuals, bird droppings, and the like.

The process of the present invention generally involves selecting an untreated textile fabric and treating the textile fabric with an aqueous treatment composition comprising a fluorochemical agent and optionally a crosslinking agent and flame retardant. The treatment composition may be applied to the textile fabric in such a manner so that the textile fabric is covered equally well on the front surface, and in some embodiments additionally the back surface, of the textile fabric. The textile fabric is then dried at an elevated temperature to form an initially treated fabric. A second treatment composition comprising a polyurethane and optionally a fluorochemical agent and flame retardant is then applied to the back surface of the initially treated fabric and dried to form the outdoor textile fabric.

In one embodiment, the textile fabrics suitable for use in the present invention may be of any known construction including a knit construction, a non-woven construction, a woven construction or combinations thereof.

The material of the textile fabric may be synthetic fiber, natural fiber, man-made fiber using natural constituents, inorganic fiber, glass fiber, or a blend of any of the foregoing. By way of example only, synthetic fibers may include polyester, acrylic, modacrylic, polyamide, polyolefin, polyaramid, polyurethane, or blends thereof. More specifically, polyester may include polyethylene terephthalate, polytrimethylene terephthalate, polybutylene terephthalate, polylactic acid, or combinations thereof. Polyamide may include nylon 6, nylon 6,6, or combinations thereof. Polyolefin may include polypropylene, polyethylene, or combinations thereof. Polyaramid may include poly-p-phenyleneteraphthalamide, poly-m-phenyleneteraphthalamide, or combinations thereof. Exemplary natural fibers include wool, cotton, linen, ramie, jute, flax, silk, hemp, or blends thereof. Exemplary man-made materials using natural constituents include regenerated cellulose (i.e., rayon), lyocell, or blends thereof.

The textile fabric may be formed from staple fiber, filament fiber, slit film fiber, or combinations thereof. The fiber may be exposed to one or more texturing processes. The fiber may then be spun or otherwise combined into yarns, for example, by ring spinning, open-end spinning, air jet spinning, vortex spinning, or combinations thereof. Accordingly, the textile fabric will generally be comprised of interlaced fibers, interlaced yarns, loops, or combinations thereof.

The textile fabric may be comprised of fibers or yarns of any size, including microdenier fibers or yarns (fibers or yarns having less than one denier per filament). The fibers or yarns may have deniers that range from less than about 0.1 denier per filament to about 2000 denier per filament or, more preferably, from less than about 1 denier per filament to about 500 denier per filament.

Furthermore, the textile fabric may be partially or wholly comprised of multi-component or bi-component fibers or yarns in various configurations such as, for example, islands-in-the-sea, core and sheath, side-by-side, or pie configurations. Depending on the configuration of the bi-component or multi-component fibers or yarns, the fibers or yarns may be splittable along their length by chemical or mechanical action.

Additionally, the fibers comprising the textile fabric may include additives coextruded therein, may be precoated with any number of different materials, including those listed in greater detail below, and/or may be dyed or colored to provide other aesthetic features for the end user with any type of colorant, such as, for example, poly(oxyalkylenated) colorants, as well as pigments, dyes, tints, and the like. Other additives may also be present on and/or within the target fiber or yarn, including antistatic agents, brightening compounds, nucleating agents, antioxidants, flame retardants, UV stabilizers, fillers, permanent press finishes, softeners, lubricants, curing accelerators, and the like.

The textile fabric may be printed or dyed, for example, to create aesthetically pleasing decorative designs on the fabric or to print informational messages on the fabric. The textile fabric may be colored by a variety of dyeing and/or printing techniques, such as high temperature jet dyeing with disperse dyes, thermosol dyeing, pad dyeing, transfer printing, screen printing, digital printing, ink jet printing, flexographic printing, or any other technique that is common in the art for comparable, equivalent, traditional textile products. In addition, the fibers or yarns comprising the textile fabric of the present invention may be dyed by suitable methods prior to substrate formation, such as for instance, via package dyeing, solution dyeing, or beam dyeing, or they may be left undyed. In one embodiment, the textile fabric may be printed with solvent-based dyes rather than water based dyes.

It is also contemplated that a textile fabric composite material may be formed by combining one or more layers of textile fabric together. For example, it may be desirable to combine several layers of an open weave textile fabric together to form a textile fabric composite material. The composite material may also include adhesive material on one or more layers of film. The composite material may then be treated with the compositions of the present invention. Alternatively, in yet another embodiment of the invention, the textile fabrics comprising the composite material may be treated with the chemical compositions before being combined into a composite material.

According to one embodiment, the textile fabric is a woven fabric made from solution dyed yarns, and in particular fabrics woven from yarns made from solution dyed acrylic, modacrylic and/or polyester fibers. Commercially available examples of this type of fabric include the Outdura® (available from Shuford Mills, Inc.), Sunbrella® and Firesist® (available from Glen Raven Inc.) line of solution dyed fabrics.

The aqueous treatment composition utilized in treating the front surface and optionally the back surface, of the textile fabric minimally contains a fluorochemical agent dispersed in water. In other embodiments, the aqueous treatment composition may further include a crosslinking agent, an antimicrobial or antifungal agent, a flame retardant, an extender, a thickening agent, a UV light absorber, a dye, a pigment and other known additives and auxiliaries used to soften, prevent abrasion and/or improve tensile and tear strength. The aqueous treatment composition does not contain a urethane latex or an acrylic latex.

Thus, according to one embodiment, the aqueous treatment composition contains from about 0.1 weight percent to less than 5 weight percent, based on the total weight of the aqueous treatment composition, of a fluorochemical agent. In another embodiment, the aqueous treatment composition contains from about 0.5 weight percent to about 4.5 weight percent of the fluorochemical agent based on the total weight of the aqueous treatment composition. In still another embodiment, the aqueous treatment composition contains from about 1 weight percent to about 3 weight percent of the fluorochemical agent based on the total weight of the aqueous treatment composition. The aqueous treatment composition may contain a single fluorochemical agent or a mixture of fluorochemical agents.

The fluorochemical agents useful in the aqueous treatment composition include any of the fluorochemical compounds and polymers known in the art to impart dry soil resistance and water- and oil-repellency to textile fabrics. These fluorochemical compounds and polymers typically comprise one or more fluorochemical radicals that contain a perfluorinated carbon chain having from about 3 to about 20 carbon atoms, more preferably from about 6 to about 14 carbon atoms. The fluorochemical radicals can contain straight chain, branched chain, or cyclic fluorinated allcylene groups, or any combination thereof. The fluorochemical radicals are preferably free of polymerizable olefinic unsaturation but can optionally contain catenary heteroatoms such as oxygen, divalent or hexavalent sulfur, or nitrogen. Fully fluorinated radicals are preferred, but hydrogen or chlorine atoms may also be present as substituents, although, preferably, no more than one atom of either is present for every two carbon atoms. It is additionally preferred that any fluorochemical radical contain from about 40% to about 80% fluorine by weight, and more preferably, from about 50% to about 78% fluorine by weight. The terminal portion of the fluorochemical radical is preferably fully fluorinated, preferably containing at least 7 fluorine atoms, for e.g., $CF_3CF_2CF_2$—, $(CF_3)_2CF$—, and $CF_5CF_2$—. In one embodiment, the fluorochemical radical is a perfluorinated aliphatic groups (i.e., those of the formula $C_nF_{2n+1}$).

Representative fluorochemical agents useful in the present invention include, without limitation, fluorochemical urethanes, ureas, esters, ethers, alcohols, epoxides, allophanates, amides, amines (and salts thereof), acids (and salts thereof), carbodiimides, guanidines, oxazolidinones, isocyanurates, and biurets, fluorochemical acrylate and substituted acrylate homopolymers or copolymers containing fluorochemical acrylate monomers interpolymerized with monomers free of non-vinylic fluorine such as methyl methacrylate, butyl acrylate, acrylate and methacrylate esters of oxyalkylene and polyoxyalkylene polyol oligomers (e.g., oxyethylene glycol dimethacrylate, polyoxyethylene glycol dimethacrylate, methoxy acrylate, and polyoxyethylene acrylate), glycidyl methacrylate, ethylene, butadiene, styrene, isoprene, chloroprene, vinyl acetate, vinyl chloride, vinylidene chloride, vinylidene fluoride, acrylonitrile, vinyl chloroacetate, vinylpyridine, vinyl alkyl ethers, vinyl alkyl ketones, acrylic acid, methacrylic acid, 2-hydroxyethylacrylate, N-methylolacrylamide, 2-(N,N,N-trimethylammonium)ethyl methacrylate, and 2-acrylamido-2-methylpropanesulfonic acid (AMPS) and blends thereof.

Commercially available fluorochemical agents that may be used in conjunction with the current invention include, but are not limited to, the Scotchgard™ family of repellent fluorochemicals (available from 3M Company), the Zonyl™ family of repellent fluorochemicals (available from E.I. du Pont de Nemours and Company), and the Repearl™ family of repellent fluorochemicals (available from Mitsubishi International Corporation).

In another embodiment, the aqueous treatment composition may contain from about 0.1 weight percent to about 10 weight percent, based on the total weight of the aqueous treatment composition, of a crosslinking agent. In yet another embodiment, the aqueous treatment composition may contain from about 0.5 weight percent to about 8 weight percent of the crosslinking agent based on the total weight of the aqueous treatment composition. In still another embodiment, the aqueous treatment composition may contain from about 1 weight percent to about 6 weight percent of the crosslinking agent based on the total weight of the aqueous treatment composition. The aqueous treatment composition may contain a single crosslinking agent or a mixture of crosslinking agents.

The crosslinking agents may include, without limitation, melamine/formaldehyde and phenol/formaldehyde resins and their variants, epoxy containing compounds, oligomeric unsaturated polyesters, mixtures of polyacrylic acid and polyols or combinations thereof. Commercially available crosslinking agents suitable for use include the alkyl modified melamine derivate Astro Mel™ NW3A crosslinking agent (available from Hexion Specialty Chemicals Inc.).

In still another embodiment, the aqueous treatment composition may contain from about 0.01 weight percent to about 4 weight percent, based on the total weight of the aqueous treatment composition, of an antimicrobial or antifungal agent. In another embodiment, the aqueous treatment composition may contain from about 0.25 weight percent to about 2 weight percent of the antimicrobial agent or antifungal agent based on the total weight of the aqueous treatment composition.

The antimicrobial or antifungal agent may be any substance or combination of substances that kills or prevents the growth of a microorganism, and includes antibiotics, antifungal, antiviral, antialgal agents and combinations thereof. Fungicides, may be also used including various tin compounds, particularly trialkyltin compounds such as tributyl tin oxide and tributyl tin acetate, copper compounds such as copper 8-quinolinolate, metal complexes of dehydroabietyl amine and 8-hydroxyquinolinium2-ethylhexoate, copper naphthenate, copper oleate, and organosilicone quarternary ammonium compounds. Other antimicrobial agents include nitrophenyl acetate, phenylhydrazine, polybrominated salicylanilides, chlorhexidine, domaphen bromide, cetylpyridinium chloride, benzethonium chloride, 2,2'-thiobisthiobis (4,6-dichloro)phenol, 2,2'-methelenebis(3,4,6'-trichloro) phenol, and 2,4,4'-trichloro-2'-hydroxydiphenyl ether. Commercially available antimicrobial agents include the ULTRA FRESH™ brand antimicrobial agents (available from Thomson Research Associates) and Skane™ or Rocima™ mildewcide (available from Rohm & Haas).

In another embodiment, the aqueous treatment composition may contain from about 0.1 weight percent to about 15 weight percent, based on the total weight of the aqueous treatment composition, of a flame retardant. In still another embodiment, the aqueous treatment composition may contain from about 0.5 weight percent to about 10 weight percent of the flame retardant based on the total weight of the aqueous treatment composition.

The flame retardant may be any one compound or a combination of compounds suitable to render the fabric fire resistant and include phosphorus compounds, for example, cyclic phosphonates, phosphate esters, and sodium or ammonium phosphates, nitrogen containing phosphonic acid salts, guanylurea phosphates and sodium borate.

In still another embodiment, the aqueous treatment composition may contain from about 0.01 weight percent to about 5 weight percent, based on the total weight of the aqueous treatment composition, of an extender. Examples of extenders suitable for use include blocked isocyanates or dispersions containing oxime blocked polyisocyanates which may be combined with paraffin wax or dispersion of paraffin oils and a fat modified melamine resin or melamine resin or methylated melamine resin.

The aqueous treatment composition may also contain from about 0.1 weight percent to about 5 weight percent, based on the total weight percent, of a softener. Softeners include silicones (including the reactive, amino, and silicone-copolyols as well as PDMS), hydrocarbons (including polyethylenes), polydimethylsiloxanes (curable and non-curable), aminosilicones (curable and non-curable), silicone copolyols (curable and non-curable), fatty acids, quaternary ammonium fatty acid esters/amides, fatty alcohols/ethers, surfactants, and polyethers (including PEG, PPG, PBG).

In another embodiment, the aqueous treatment composition may also contain from about 5 weight percent to about 25 weight percent, based on the total weight of the aqueous treatment composition, of a UV light absorber. Ultraviolet light can do great damage to outdoor fabric causing photodegradation, yellowing, loss in strength and fading of the colors. The damage is generally due to the formation of destructive free radicals. UV light absorbers can protect the outdoor fabric by shielding the fiber or absorbing the light or by chemically quenching the free radicals. Examples of UV light absorbers include substituted benzotriazines, benzotriazoles, benzophenones such as 2-hydroxybenzophenones; 2-hydroxybenzotriazoles; double benzophonones, hydroxybenzoates; metal chelate stabilizers; hindered amine light stabilizers and mixtures of these chemistries.

The aqueous treatment composition may be prepared by mixing the fluorochemical agent with any other components in water until a uniform dispersion is obtained. The water is present in the aqueous treatment composition in an amount from about 70 weight percent to about 97 weight percent based on the total weight of the aqueous treatment composition.

The second treatment composition utilized in treating the back surface of the textile fabric minimally contains a polyurethane. In other embodiments, the treatment composition may further include a fluorochemical agent, an antimicrobial or antifungal agent, a flame retardant, a crosslinking agent, a wax extender, a thickening agent, a defoaming agent, a neutralization agent, and other known additives and auxiliaries used to prevent abrasion and/or improve tensile and tear strength.

Thus, according to one embodiment, the second treatment composition contains from about 40 weight percent to about 85 weight percent, based on the total weight of the second treatment composition, of a polyurethane. In another embodiment, the second treatment composition contains from about 60 weight percent to about 80 weight percent of the polyurethane based on the total weight of the aqueous treatment composition. The second treatment composition may also contain a mixture of polyurethanes.

In principle, all of the well-known polyurethanes prepared by polyaddition of a di- or polyfunctional isocyanate and a di- or polyfunctional alcohol can be utilized in the second treatment composition according to the invention.

According to one embodiment, the polyurethanes are derived from aliphatic, cycloaliphatic, araliphatic or aromatic diisocyanates. Examples of such diisocyanate compounds include hexamethylene diisocyanate, biuret of hexamethylene diisocyanate, 2,2,4-trimethyl-hexamethylene diisocyanate, 1,4-diisocyanatocyclohexane, 4,4'-diisocyanatodicyclohexylmethane, isophorone diisocyanate, toluene diisocyanate, 1,3-cyclohexane bis(methylisocyanate), 1,4-diisocyanatobenzene, diphenylmethane diisocyanate in the form of its 2,2'-, 2,4'- and 4,4'-isomers, diisocyanatotoluene in the form of its 2,4- and 2,6-isomers and 1,5-diisocyanatonaphthalene.

According to another embodiment, the di- or polyfunctional alcohols suitable for the preparation of polyurethanes are hydroxy-terminated polyethers, hydroxy-terminated polycarbonates and hydroxy-terminated polyesters. Examples of the hydroxy-terminated polyether di- or polyfunctional alcohols include polyoxypropylene or polyoxy ethylene diols and triols and poly(oxyethyleneoxypropylene) diols and triols. Examples of hydroxy-terminated polycarbonate di- or polyfunctional alcohols include products obtained by reacting monomers such as diols having from 2 to 10 carbon atoms, for example, 1,3-propanediol, 1,4-butanediol, 1,6-hexanediol, diethylene glycol or tetraethylene glycol, with diaryl carbonates having from 13 to 20 carbon atoms, for example diphenyl carbonate, or with phosgene.

According to another embodiment, the polyurethane is an isocyanate-terminated reaction product of polyisocyanates and hydroxy-terminated polyesters, more specifically the polyaddition product of a diisocyanate and a polyester polyol produced by reacting a difunctional acid with an excess of a di- and/or tri-functional alcohol. As the difunctional acid preferably succinic acid and especially adipic acid are used. The di- and/or tri-functional alcohol may be an alkane diol or triol having 2 to 6 carbon atoms; these alcohols optionally can contain ether groups and/or can contain diamine components or polyether alcohols. The difunctional alcohol may be ethylene glycol, propylene glycol, diethylene glycol, dipropylene glycol, polyethylene glycol or polypropylene glycol.

Examples of commercially available polyurethanes include Dicrylan® PGS, and Dicrylan® PAD polyurethanes (available from Huntsman Corporation).

According to another embodiment of the present invention, the second treatment composition further contains a fluorochemical agent similar to that in the aqueous treatment composition. However, the amount of fluorochemical agent present in the second treatment composition is higher than in the aqueous treatment composition. Thus, in one embodiment, the second treatment composition contains from about 5 weight percent to about 20 weight percent, based on the total weight of the second treatment composition, of the fluorochemical agent. In another embodiment, the second treatment composition contains from about 3 weight percent to about 15 weight percent of the fluorochemical agent based on the total weight of the second treatment composition.

As mentioned above, the second treatment composition may also include an antimicrobial or antifungal agent, a flame retardant, extender, a crosslinking agent, a thickening agent, a defoamer, a neutralization agent, and other known additives and auxiliaries to prevent abrasion and/or improve tensile and tear strength. The antimicrobial or antifungal agent, flame retardant, extender and crosslinking agent are similar to those contained in the aqueous treatment composition. The antimicrobial or antifungal agent may be present in the second treatment composition at an amount ranging from about 0.01 weight percent to about 5 weight percent based on the total weight of the second treatment composition. The flame retardant may be present in the second treatment composition at an amount ranging from about 0.1 weight percent to about 30 weight percent based on the total amount of the second treatment composition. The extender may be present in the second treatment composition at an amount ranging from about 0.01 weight percent to about 5 weight percent based on the total weight of the second treatment composition. The crosslinking agent may be present in the second treatment composition at an amount ranging from about 0.5 weight percent to about 8 weight percent based on the total weight of the second treatment composition.

In another embodiment, the second treatment composition may also contain from about 0.1 weight percent to about 10 weight percent, based on the total weight of the second treatment composition, of a thickening agent. In still another embodiment, the second treatment composition contains from about 0.5 weight percent to about 6 weight percent of the thickening agent based on the total weight of the second treatment composition. The thickening agent may or may not be neutralized.

The thickening agent may be any substance or mixture of substances used to adjust the rheological properties of the second treatment composition. Such thickening agents are well known, and include water soluble, generally high molecular weight natural and synthetic materials. Examples of natural thickening agents include the various water soluble gums such as gum acacia, gum tragacanth guar gum, and the like. Examples of synthetic materials include modified celluloses and starches, such as alkyl cellulose and hydroxyalkylcellulose, for example, methylcellulose, hydroxymethylcellulose, hydroxyethylcellulose, propylcellulose, and the like. Other synthetic materials include high molecular weight synthetic polymers such as polyacrylic acid; copolymers of acrylic acid with minor amounts of copolymerizable monomers such as methyl acrylate, methacrylic acid, acrylonitrile, vinylacetate, and the like, as well as the salts of these compounds with alkali metal ions or ammonium ions, polyvinylalcohol and partially hydrolyzed polyvinylacetate; polyacrylamide; polyoxyethylene glycol; long chain alkylene oxide capped polyoxyethylene glycols and polyols or their copolymer polyoxyethylene/polyoxypropylene analogues.

The second treatment composition may be prepared by mixing the polyurethane, and optionally the fluorochemical agent, and any other ingredients until a uniform dispersion is obtained. Water and/or a neutralization agent, for example, ammonia, may also be added to the aqueous treatment composition in an amount from about 0.5 weight percent to about 15 weight percent based on the total weight of the second treatment composition.

If desired, prior to treatment, the textile fabric may be scoured to eliminate any residual sizing agents left from fabric production before application of the aqueous treatment composition and second treatment composition. After scouring, the textile fabric may then be dried.

The first step of the process involves treating the textile fabric with the aqueous treatment composition. Treatment of the textile fabric by the aqueous treatment composition may be accomplished by a variety of application methods including, but not limited to, spraying, foaming, padding, steaming, exhausting or any other technique whereby one can apply a controlled amount of liquid suspension to a textile fabric. The fabric may be passed through nips or nip rollers to facilitate a more thorough penetration of the aqueous treatment composition into the fabric and/or adjust the amount of aqueous treatment composition relative to the textile fabric (i.e. "wet pickup"). The wet pick up (wpu) of the fabric may be expressed as:

$$\% \text{ wpu} = \frac{\text{weight of composition applied} \times 100}{\text{weight of dry fabric}}$$

In one embodiment, the wet pickup is adjusted to provide from about 25 weight percent to about 150 weight percent wet pickup relative to the weight of the untreated textile fabric, and more preferably from about 50 weight percent to about 100 weight percent. Application of the aqueous treatment composition in the first step results in a first chemical layer being proximal or contiguous with the front surface of the textile fabric. In embodiments where the back surface of the textile surface has also been treated with the aqueous treatment composition, a first chemical layer will also be proximal or contiguous with back surface.

After the textile fabric has been treated with the aqueous treatment composition, the treated fabric is exposed to elevated temperatures to evaporate the desired amount of liquid from the fabric and/or cure the active components on the surface to form an initially treated fabric. Heating can be accomplished by a variety of techniques including oven drying, microwave energy, infrared heating, steam, superheated steam, autoclaving or combinations thereof. In one embodiment, the treated textile fabric is dried and cured using an oven at an elevated temperature ranging between 100°-200° C. for a period from about 1 minute to 8 minutes.

The second step of the process involves applying the second treatment composition to the back surface of the initially treated fabric and drying the fabric to form the outdoor textile fabric. In embodiments were the back surface has been treated with the aqueous treatment composition, the second treatment composition would be proximal or contiguous with the first chemical layer. The second treatment composition may be applied to the back surface by any known technique, including without limitation, employing the use of a hot melt adhesive layer, by direct calendar lamination or by extrusion lamination. In other embodiments, the second treatment composition may be rolled or sprayed onto the back surface of the initially treated fabric and than passed under a knife blade, doctor blade or roller to provide a thin coating which may be heated and/or cured in an oven at temperatures ranging from about 149° C.-200° C. for a period of about 1 minute to 8 minutes.

In yet another embodiment, the outdoor textile fabric may be exposed to an additional heating step to further enhance the performance and durability of the solid active components. Additional heating may enable the solid active components on the outdoor textile fabric to melt-flow together resulting in uniform cohesive layers, and induce alignment and crosslinking reactions between the solid active components or between the solid active components and the fabric.

The outdoor textile fabric thus produced may be used in a variety of outdoor applications including automotive and marine applications, covers, canopies, banners, military applications, awnings, tents, umbrellas, and casual outdoor furniture.

EXAMPLES

Test Methods a) Add-On (ASTM D3776-96). Add-On relates to the amount of treatment composition that was applied onto a test sample and was determined by subtracting the original (greige) weight of the test sample from the finished (treated) weight of the test sample $$\% \text{ add-on}(\text{oz/yd}^2) = \text{weight of treated sample} - \text{weight of original(greige)sample}$$

b) Water Resistance: Hydrostatic Pressure (AATCC TM 127-2003). Water resistance was tested according to AATCC TM 127-2003, the contents of which are hereby incorporated by reference. This test measured the resistance of a test sample to the penetration of water under hydrostatic pressure. A surface of the test sample was subjected to a hydrostatic pressure, which was increased at a constant rate until three points of leakage appeared on the test sample's other surface. The water resistance was then measured in centimeters $H_2O$.

c) Water Repellency: Spray Test (AATCC TM 22-2005). Water repellency was tested according to AATCC Test Method 22-2005, the contents of which are hereby incorporated by reference. Water was sprayed against the taut surface of a test sample under controlled conditions to produce a wetted pattern whose size depended on the repellency of the fabric. Evaluation was accomplished by comparing the wetted pattern with pictures on a standard chart as follows:

100—No sticking or wetting of the upper surface.
90—Slight random sticking or wetting of the upper surface.
80—Wetting of upper surface at spray points.
70—Partial wetting of whole of upper surface.
50—Complete wetting of whole of upper surface.
0—Complete wetting of whole of upper and lower surfaces.

d) Oil Repellency: Hydrocarbon Resistance Test (AATCC TM 118-2002). Oil repellency was tested according to AATCC Test Method 118-02002. A test sample was placed on a flat horizontal surface. Drops of standard liquid hydrocarbons were placed on the surface of the test sample and observed for wetting, wicking, and contact angle. The oil repellency grade relates to the highest numbered test liquid which does not wet the test sample's surface.

e) Breaking Strength and Elongation (ASTM D5034-95). The breaking strength and elongation of test samples was tested according to ASTM D5034-95, the contents of which are incorporated herein by reference. The results are express in pounds to break and represent the "load" or the maximum force required to break or rupture the test sample in a tensile test. Higher numbers indicate a stronger fabric.

f) Tearing Strength of Fabrics by the Tongue (Single Rip) Procedure (ASTM D2261-96). The tearing strength of a test sample was tested according to ASTM D2261-96 the contents of which are incorporated herein by reference. A rectangular test sample was cut in the center of a short edge to form a two-tongued specimen. One tongue was then gripped in an upper jaw and the other gripped in a lower jaw of a tensile testing machine. The separation of the jaws was then continuously increased to apply a force to propagate the tear. The force to continue the tear was then calculated from a data collection system.

g) Colorfastness to Crocking (AATCC TM 8-2005). The colorfastness of a test sample was measured according to AATCC Test Method 8-2005, the contents of which are hereby incorporated by reference. This test method is designed to determine the amount of color transferred from the surface of colored textile fabric to other surfaces by rubbing. A colored test sample was rubbed with a white crock test cloth under controlled conditions. Rating of the crocked specimen was done by means of comparison to the Gray Scale for Staining with ratings of 1 to 5 with 1 being the worst and 5 being the best.

h) Flame Retardancy (19 CCR 1237 California State Fire Marshall (CSFM) California Code of Regulations Title 19 Public Safety). Flame retardancy was measured according to 19 CCR 1237 California State Fire Marshall (CSFM) California Code of Regulations Title 19 Public Safety. Sample test specimens were first conditioned by suspending them in an oven having mechanical air circulation at temperatures of 140°-145° F. for not less than one hour and not more than one and one half hours. The specimens, each not less than two and one half inches by twelve and one half inches were then subjected to the fire resistance test. One half of each specimen was cut with the long dimension in the direction of the warp and the other half with the long dimension in the direction of the filling. The specimens were suspended vertically in a rack which covered the upper one half inch of the length and their sides were held firmly to prevent curling, leaving a strip two inches by twelve inches exposed. To protect the specimens from drafts, the testing apparatus was enclosed in a sheet metal shell twelve inches wide, twelve inches deep, and thirty inches high which was open at the top and was also provided with a vertical sliding glass front. Sufficient room was left at the bottom of the front to allow manipulation of the gas burner used in igniting the specimens. The specimens were suspended with their lower end three quarters inch above the top of a three eights inch I.D. Bunsen or Tirril gas burner. The flame was applied vertically at the center of the width of the lower end of the specimens for twelve seconds, then withdrawn, and the duration of flaming in the specimens after withdrawal of the burner was noted. After complete extinction of all flame and glow in the specimen, the length of char was measured.

i) Bag Test. Test fabric samples were cut in a 12×12 square with each end tied up to make an umbrella. The fabric was then held upside down and water was poured into the cavity and held for 24 hours. A passing rating indicates that no leakage occurred.

Examples 1-3

The following aqueous treatment compositions and second treatment compositions were prepared as follows:

Example 1

Based on 60% Wet Pick-Up

| Ingredient | Amount (weight percent) |
|---|---|
| Aqueous Treatment Composition: | |
| Fluorochemical agent | 1-4.99 |
| Crosslinking agent | 1-8 |
| Flame retardant | 1-10 |
| Water | 77-97 |
| Second Treatment Composition: | |
| Polyurethane | 40-80 |
| Fluorochemical agent | 5-15 |
| Crosslinking agent | 1-5 |
| Flame retardant | 10-30 |
| Thickening agent | 0.1-1.0 |
| Water | 1-10 |
| Neutralization agent (ammonia) | 1-5 |
| Defoaming agent | 0.1-1.0 |

Example 2

Based on a 60% Wet Pick-Up

| Ingredient | Amount (weight percent) |
|---|---|
| Aqueous Treatment Composition: | |
| Fluorochemical agent | 1-4.99 |
| Crosslinking agent | 1-5 |
| Softener | 1-5 |
| Water | 82-97 |
| Second Treatment Composition: | |
| Polyurethane | 40-80 |
| Fluorochemical agent | 5-10 |
| Antimicrobial or Antifungal agent | 0.1-0.5 |
| Thickening agent | 1-8 |
| Water | 1-10 |
| Defoaming agent | 0.1-1.0 |

Example 3

Based on a 60% Wet Pick-Up

| Ingredient | Amount (weight percent) |
|---|---|
| Aqueous Treatment Composition: | |
| Fluorochemical agent | 1-4.99 |
| Crosslinking agent | 1-10 |
| Softener | 1-5 |
| Flame Retardant | 1-10 |
| Water | 72-96 |
| Second Treatment Composition: | |
| Polyurethane | 40-80 |
| Fluorochemical agent | 5-10 |
| Antimicrobial or Antifungal agent | 0.1-0.5 |
| Thickening agent | 1-6 |
| Water | 1-10 |
| Defoaming agent | 0.1-1.0 |

The aqueous treatment compositions of Examples 1-3 were then applied to a polyester fabric by padding and the fabric was dried at a temperature between 160°-200° C. The initially treated fabric was then coated with the second treatment compositions of Examples 1-3 with a knife over roller and dried between 160°-200° C. The treated polyester fabrics were then tested according to the methods described above and the results are presented below:

| Test | Example 1 | Example 2 | Example 3 |
|---|---|---|---|
| Water Repellency | 100 | 100 | 90 |
| Water Resistance | 78 cm | 79 cm | 104 cm |
| Oil Repellency | 4 | 4 | 4 |
| Breaking Strength | * | 354 Inch-pound warp<br>217 Inch-pound fill | * |
| Tear Strength | * | 18 lbs. warp<br>12 lbs. fill | * |
| Bag Test | * | Pass | Pass |
| Crocking | 5 | 5 | 5 |
| Flame Retardancy | 025 sec/<br>4.375 in. warp | 0.63 sec/5.31 in. warp<br>1.4 sec/5.31 in fill | 1.3 sec/<br>5.55 in. warp<br>1.06 sec/<br>5.20 in. fill |

* Not tested.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A process for preparing an outdoor textile fabric comprising the steps of:

(a) selecting an untreated textile fabric having a front surface and a back surface;

(b) treating the front surface of the untreated textile fabric with an aqueous treatment composition comprising from about 0.1 weight percent to about 5 weight percent, based on the total weight of the aqueous treatment composition, of a fluorochemical agent and from about 0.1 weight percent to about 10 weight percent, based on the total weight of the aqueous treatment composition, of a crosslinking agent comprising a melamine/formaldehyde or phenol/formaldehyde resin and wherein the aqueous treatment does not contain a urethane latex or an acrylic latex and wherein the treatment results in a first chemical layer being contiguous with the front surface;

(c) drying the textile fabric to obtain an initially treated fabric;

(d) applying to the back surface of the initially treated fabric, wherein the back surface of the initially treated fabric is uncoated, a second treatment composition comprising from about 40 weight percent to about 85 weight percent, based on the total weight of the second treatment composition, of a polyurethane wherein the application results in the second treatment composition being contiguous with the back surface; and (e) drying the initially treated fabric to obtain the outdoor textile fabric.

2. The process according to claim 1 wherein the untreated textile fabric is a woven fabric.

3. The process according to claim 2 wherein the woven fabric comprises synthetic fibers selected from the group consisting of polyester fibers, acrylic fibers, modacrylic, polyimide fibers, polyolefin fibers, polyaramid fibers, polyurethane fibers, and blends thereof.

4. The process according to claim 3 wherein the synthetic fibers are polyester fibers.

5. The process according to claim 1 wherein the aqueous treatment composition further comprises a flame retardant.

6. The process according to claim 1 wherein the textile fabric is dried at an elevated temperature ranging between 100°-200° C.

7. The process according to claim 1 wherein the second treatment composition further comprises from about 5 weight percent to about 20 weight percent, based on the total weight of the second treatment composition, of a fluorochemical agent.

8. The process according to claim 1 wherein the initially treated fabric is dried at a temperature ranging from about 149°-200° C.

9. The process according to claim 1 wherein the aqueous treatment composition further comprises a softener.

10. The process according to claim 1 wherein the second treatment composition further comprises a flame retardant.

11. The process according to claim 1 wherein the second treatment composition further comprises a crosslinking agent.

12. The process according to claim 1 wherein the second treatment composition further comprises an extender.

13. The process according to claim 1 wherein the second treatment composition further comprises an antimicrobial or antifungal agent.

14. The process according to claim 1 wherein the second treatment composition further comprises a thickening agent which may or may not need to be neutralized.

* * * * *